United States Patent [19]

Uffner

[11] 4,440,816

[45] Apr. 3, 1984

[54] RUBBER-MODIFIED ASPHALT COMPOSITION

[75] Inventor: William E. Uffner, Newark, Ohio

[73] Assignee: Owens-Corning Fiberglas Corporation, Toledo, Ohio

[21] Appl. No.: 360,729

[22] Filed: Mar. 22, 1982

Related U.S. Application Data

[63] Continuation of Ser. No. 167,986, Jul. 14, 1980, abandoned.

[51] Int. Cl.[3] ..... D06N 7/00; C08L 95/00

[52] U.S. Cl. ..... 428/40; 428/251; 428/261; 428/263; 428/268; 428/285; 428/288; 428/291; 428/343; 428/375; 428/392; 428/440; 428/489; 525/54.5

[58] Field of Search ..... 428/343, 352, 440, 489, 428/369, 375, 291, 40, 392; 106/273 N; 208/44; 523/150, 317; 524/71; 525/54.5

[56] References Cited

U.S. PATENT DOCUMENTS

| | | | |
|---|---|---|---|
| 2,578,001 | 12/1951 | Cubberley et al. . | |
| 2,610,162 | 9/1952 | Hoffman . | |
| 3,338,849 | 8/1967 | Johnson | 524/68 |
| 3,474,625 | 10/1969 | Draper et al. . | |
| 3,547,850 | 12/1970 | Montgomery . | |
| 3,721,578 | 3/1973 | Bennett et al. . | |
| 3,741,856 | 6/1973 | Hurst . | |
| 3,900,102 | 8/1975 | Hurst | 206/411 |
| 3,919,148 | 11/1975 | Winters et al. . | |
| 3,932,341 | 1/1976 | Kutch et al. . | |
| 4,008,095 | 2/1977 | Fukushima et al. . | |
| 4,021,393 | 5/1977 | MacDonald . | |
| 4,064,082 | 12/1977 | Henschel | 260/27 EV |
| 4,074,948 | 2/1978 | Heater . | |
| 4,105,612 | 8/1978 | Cushman et al. | 260/27 EV |
| 4,154,710 | 5/1979 | Maldonado et al. . | |
| 4,164,490 | 8/1979 | Hagenbach et al. . | |
| 4,172,061 | 10/1979 | Bresson . | |
| 4,175,978 | 12/1979 | Marzocchi et al. | 106/281 R |
| 4,217,259 | 8/1980 | Bresson . | |
| 4,243,426 | 1/1981 | Marzocchi et al. . | |
| 4,273,685 | 6/1981 | Marzocchi et al. | 523/150 |
| 4,335,186 | 6/1982 | Marzocchi et al. | 428/375 |
| 4,362,780 | 12/1982 | Marzocchi et al. | 428/283 |

FOREIGN PATENT DOCUMENTS

| | | |
|---|---|---|
| 51-53522 | 5/1976 | Japan . |
| 2015002 | 9/1979 | United Kingdom . |

OTHER PUBLICATIONS

The Petromat System ©, 1978, Phillips Fibers Corporation, ROADGLAS TM Spot Repair System, Owens-Corning Fiberglas Corporation.

*Primary Examiner*—P. E. Willis, Jr.
*Attorney, Agent, or Firm*—Ronald C. Hudgens; Robert F. Rywalski; Keith V. Rockey

[57] ABSTRACT

A rubber-modified asphalt composition prepared by reacting a bituminous material with (1) a polymerizable aromatic monomer and (2) a depolymerized rubber whereby the rubber is chemically integrated with the asphalt. The rubber-modified asphalt compositions of the invention can be used in the treatment of glass fibers as well as in road paving applications, roofing applications and the like.

30 Claims, No Drawings

RUBBER-MODIFIED ASPHALT COMPOSITION

This is a continuation of application Ser. No. 167,986, filed July 14, 1980, now abandoned.

This invention relates to rubber-modified asphalt compositions, and more specifically to asphalt compositions which have been chemically modified to promote compatibility and adhesion between the asphalt and reinforcement employed with the asphalt.

In application Ser. No. 881,108, filed Feb. 24, 1978, and Ser. No. 45,047, now U.S. Pat. No. 4,273,685, filed June 4, 1979, there is disclosed an asphalt composition which has been chemically modified with the rubbery polymer to increase fire retardancy and chemical reactivity of the asphalt. The modification of the asphalt with a rubbery polymer also has been found to promote compatibility between the asphalt and reinforcements used with the asphalt, notably glass fibers, glass flake and other organic and inorganic fillers and reinforcements.

The chemically-modified asphalts disclosed in the foregoing copending applications are prepared by reaction of a bitumen, and preferably asphalt, with a vinyl aromatic monomer such as styrene and a rubbery polymer. It has been postulated that the vinyl aromatic monomer employed as a coreactant is polymerizable with ethylenic unsaturation contained in the bitumen and thus serves to couple, by means of chemical bonds, the asphalt molecules with the rubber polymer. The resulting chemically-modified asphalt can thus be cross linked with the use of a suitable cross-linking agent well known to those skilled in the art. In addition, the rubbery polymer which has been chemically bonded to the asphalt can serve as a source of reaction sites to establish a chemical bond between the chemically-modified asphalt and reinforcing fillers such as glass fibers, siliceous aggregate, glass flake and combinations thereof which are blended with the chemically-modified asphalt in reinforced asphalt systems.

In the preparation of chemically-modified asphalt compositions as is described in the foregoing applications, it was found that the reaction could be caused to take place by simply contacting the rubbery polymer with the vinyl aromatic monomer, and heating the resulting mixture. It was found that, while a catalyst could be used to promote the reaction, the reaction would also proceed in the absence of the catalyst.

The resulting rubber-modified asphalt was found to be substantially free from tackiness and could be used in the treatment of glass fibers for a variety of applications, including road-repair and/or road-paving applications, roof repair applications and the like.

One of the difficulties in the use of rubber-modified asphalt as described in the foregoing applications arises from the fact that the resulting rubber-modified composition has virtually no tackiness, and hence is unsuitable for some applications where adhesive qualities are desired. In addition, the modification of the asphalt to chemically bond to it a rubbery polymer results in increased viscosity which makes such compositions more difficult to apply as a coating on fillers such as a coating on glass fiber surfaces.

It is accordingly an object of this invention to provide a chemically-modified asphalt system which overcomes the disadvantages described above.

It is a more specific object of this invention to provide a chemically-modified composition wherein the asphalt molecules are chemically combined with elastomeric material to control the viscosity of the resulting modified asphalt and to provide increased tack for use of the composition as an adhesive.

The concepts of this invention reside in the discovery that depolymerized rubber can be reacted with asphalt in the presence of a polymerizable vinyl aromatic monomer to provide a rubber-modified asphalt having good adhesive characteristics. The use of a depolymerized rubber also has been found to control the viscosity of the resulting rubber-modified asphalt to facilitate its use in the coating of reinforcing and/or filler materials, including the coating of glass fibers for use as reinforcement for asphalt systems.

Without limitation as to theory, it is believed that the vinyl aromatic monomer serves to couple, through chemical bonds, the depolymerized rubber polymer to the asphalt by reaction with the ethylenic unsaturation of the asphalt. Once it is chemically combined with the asphalt, the depolymerized rubber serves to reduce the viscosity of the rubber-modified asphalt composition and to increase its tack for use as an adhesive. The resulting rubber-modified asphalt thus has a relatively low viscosity so that it can be used in the coating of various fillers, including glass fillers, glass flakes, siliceous aggregate and combinations thereof to provide coated fillers and reinforcements which can be adhesively bonded to substrates to serve as fillers and reinforcements therefor. The depolymerized rubber chemically bonded to the asphalt serves to increase the modulus of the asphalt and also to provide a source of reaction sites to establish a secure chemical bond between the chemically-modified asphalt and such reinforcing fillers when such fillers are blended with the chemically-modified asphalt in reinforced asphalt systems.

The term "depolymerized rubber", as used herein, is intended to include and refer to a number of commercially available low molecular weight natural and synthetic polymers. Depolymerized rubber generally refers to a natural rubber which has been depolymerized to decrease its molecular weight by treatment with a depolymerizing agent, e.g., with alkali, but also includes depolymerized synthetic rubbers, and particularly depolymerized synthetic conjugated diene polymers, such as depolymerized synthetic polyisoprene, depolymerized synthetic polybutadiene, depolymerized synthetic polychloroprene. Generally, the depolymerized rubbers employed in the practice of this invention have average molecular weights ranging from 10,000 to 110,000 and desirably about 30,000 to about 80,000. Various preferred depolymerized rubbers are available from Hardman Inc. under the trademark "Isolene D", a series of liquid depolymerized virgin synthetic polyisoprene polymers, and "DPR", a series of liquid depolymerized natural rubbers. Chemically, such polymers are cis-1,4-polyisoprene having low molecular weights and Brookfield (RVT) viscosities ranging from about 30,000 to about 500,000 cps at 100° F. (38° C.). Especially preferred is DPR-400 which has a viscosity of 300,000 to 500,000 cps at 38° C. (Brookfield RVT, 5 RPM, Spindle No. 7).

As the polymerizable vinyl monomer, use is preferably made of a monofunctional vinyl aromatic monomer having a general formula:

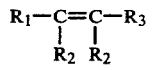

wherein $R_1$ is an aromatic group containing 6 to 12 carbon atoms, including a phenyl group, a substituted phenyl group wherein the substituent is any one of an amino group, a cyano group, a halogen group, a $C_1$ to $C_3$ alkoxy group, a $C_1$ to $C_3$ alkyl group, a hydroxy group, a nitro group, etc. $R_1$ can also be a heterocyclic aromatic group such as a pyridine group, a quinoline group of the like. $R_2$ is preferably hydrogen or lower alkyl, e.g., a $C_1$ to $C_5$ alkyl, such as methyl; and $R_3$ is hydrogen, methyl, or one of the following groups:

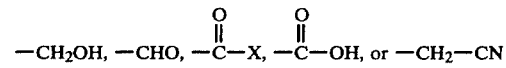

X is halogen, and perferably chlorine or bromine. Illustrative of such vinyl aromatic monomers are styrene, p-aminostyrene, o-methoxystyrene, 2-vinyl pyridine, 3-vinyl quinoline, alpha-methylstyrene, cinnamyl alcohol, cinnamyl aldehyde, cinnamyl chloride and cinnamic acid, etc.

As will be appreciated by those skilled in the art, it is also possible and desirable, for some applications, to formulate the reaction mixture to include a non-depolymerized rubbery polymer, particularly as to applications where low tack and/or adhesiveness is desired. As a general rule, the greater the quantity of non-depolymerized rubbery polymer employed, the lower is the degree of tackiness of the resulting rubber-modified asphalt compositions.

As the non-depolymerized rubber polymer, use can be made of a number of elastomeric materials well known to those skilled in the art. Included are natural rubbers as well as synthetic rubbers. Suitable are synthetic rubbers which are homopolymers of a conjugated diene (e.g., butadiene, isoprene, chloroprene, etc.) as well as various polymers which are substituted with a functional group containing a labile hydrogen atom. For example, various hydroxy, amino and like substituted homopolymers of conjugated dienes may likewise be used in the practice of this invention. Such substituted butadienes are commercially available from, for example, Atlantic-Richfield under the trademark "Poly B-D", a series of hydroxy-terminated butadiene polymers; for example, use can be made of hydroxy-terminated butadiene homopolymers (e.g., Poly B-D R-15M which has a hydroxy number of 42 or Poly B-D R-45M).

In addition, use can preferably be made, as the non-depolymerized rubbery polymers, of elastomeric materials formed by copolymerization of one or more of the conjugated dienes described above with one or more ethylenic monomers such as styrene as well as hydroxy, amino and mercapto-substituted derivatives thereof, acrylonitrile, methacrylonitrile, acrylic acid, methacrylic acid, etc. Included are butadiene-styrene rubbers, butadiene-acrylonitrile rubbers, etc. Hydroxy-terminated copolymers are likewise useful in the practice of this invention, including the hydroxy-terminated butadiene-styrene copolymer designated "Poly B-D CS-15" and hydroxy-terminated butadiene-acrylonitrile copolymers (e.g., Poly B-D CN-15 having a hydroxyl number of 39). Particularly well suited for use in this invention is the butadiene-styrene rubber marketed by Phillips Petroleum as "Solprene 1205C".

In general, the non-depolymerized rubbery polymers which may optionally be employed in the practice of this invention are rubbery polymers having a higher molecular weight than the depolymerized rubbers.

For some applications, the tack and viscosity of the resulting chemically-modified asphalt composition can be further controlled by formulating the composition to include a terpene resin. As is described in copending applications Ser. No. 168,901 and Ser. No. 167,985, filed concurrently herewith, the disclosures of which are incorporated herein by reference, such terpene resins can be formulated in the composition when the polymerizable vinyl aromatic monomer is reacted with the asphalt and rubber component, or the terepene resin can be blended with the rubber-modified asphalt composition after the vinyl aromatic monomer has been reacted with the asphalt and the rubbery component.

As the terpene resin, use can be made of a number of synthetic polyterpene resins commercially available. One such resin is marketed by Goodyear Chemicals under the trademark "Wingtack", including the Wingtack 95 resin which is a synthetic polyterpene derived from $C_5$ hydrocarbon resins. Another Wingtack resin useful in the practice of this invention is known as Wingtack 115, a resin chemically similar to Wingtack 95, except that Wingtack 115 has been polymerized to a higher softening point. Another, and frequently preferred terpene resin, are the terpene resins manufactured by Hercules Incorporated under the trademark "Piccolyte" resins, including the A100, A115, A125 and A135 resins, with A115 being preferred. Those resins are all derived from the monomer alpha-pinene. They have melt viscosities ranging from 185° to 220° C. at 1 poise. Another suitable commercially available terpene resin is Nevpene 9500, available from Nevelle Chemical Company.

In carrying out the reaction of the asphalt in accordance with the practice of this invention, it has been found that no catalysts are required, although free radical catalysts may be used, if desired. It is sufficient that the mixture of the asphalt, the vinyl aromatic monomer, the depolymerized rubber, and, optionally, the terpene resin and/or the rubbery polymer, be heated to a temperature ranging from 200°-500° F., and preferably around 340° F.-380° F. to promote the reaction. As will be appreciated by those skilled in the art, the reaction time is somewhat dependent on the reaction temperature with higher temperatures favoring a more rapid rate of reaction. If desired, the asphalt can be, prior to reaction, dissolved in an inert organic solvent, preferably an aromatic solvent, although the use of the solvent is not necessary. It is generally preferred to carry out the reaction under non-oxidizing conditions to avoid combustion. Use of an inert gas can be made for that purpose.

In accordance with one variation of the practice of this invention, the reaction time for chemically combining the asphalt, the depolymerized rubber and the vinyl aromatic monomer can be reduced by utilizing, in conjunction with the vinyl aromatic monomer as described above, a polyfunctional aromatic monomer containing 6 to 12 carbon atoms in the aromatic ring and two or more polymerizable vinyl groups chemically bonded to the aromatic ring. It has been found that the use of polyfunctional vinyl aromatic monomer in combination with the monofunctional vinyl aromatic monomer described above does serve to increase the reaction time necessary to chemically combine the asphalt with the depolymerized rubber, and, optionally, the terpene resin.

Preferred polyfunctional monomers are those having the general formula:

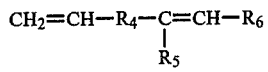

wherein $R_4$ is a divalent aromatic group containing 6 to 12 carbon atoms, and preferably a phenylene group; and, $R_5$ and $R_6$ have the same meaning as is described above with respect to $R_2$ and $R_3$, respectively. Illustrative of suitable polyfunctional vinyl aromatic monomers are divinyl benzene, and the cinnamyl styrenes described above.

The proportions employed in formulating this reaction mixture of the composition of this invention can be varied within relatively wide limits. In general, the proportion of the depolymerized rubber employs ranges from about 5 to 45% by weight based on the weight of the asphalt while the total amount of the vinyl aromatic monomer ranges from 5 to 50% by weight based on the weight of the asphalt. When it is used at all, the non-depolymerized rubber can be used in amounts sufficient to reduce the tackiness of the resulting composition. Depending somewhat on the application, that amount ranges from 0 to 40% by weight based on the weight of the asphalt. Similarly, the terpene resin, when employed, can be varied, depending on the weight and viscosity desired. Best results are achieved when the quantity of the terpene resin ranges up to about 75% by weight based on the weight of the asphalt, and generally in the range of 20 to 70% by weight.

When use is made of a polyfunctional vinyl aromatic monomer in combination with a monofunctional vinyl aromatic monomer such as styrene, generally the monofunctional is present in a weight ration of about 1:1 to 40:1 based on the weight of the polyfunctional vinyl aromatic monomer.

In carrying out the reaction used to produce rubber-modified asphalts of this invention, use can be made of ordinary asphalt or asphalt which has been modified by reaction with air (e.g., blown asphalt), steam, ammonia or organic amines as described in copending application Ser. No. 852,898, filed Nov. 18, 1977.

It has been found that the interreaction of a vinyl aromatic monomer and the depolymerized rubber with the asphalt produces a cross linked asphalt. The resulting asphalt, having improved compressive strength, can thus be used in a variety of applications. For example, the asphalt compositions of this invention are highly suitable for use in road repair and/or road paving applications, and particularly road paving applications wherein the asphalt is reinforced with glass, either in the form of glass fibers or in the form of glass frit. It is believed that the reaction of the vinyl aromatic compound and the depolymerized rubber serves to impart to the asphalt reactive groups which are capable of establishing a chemical bond between the asphalt and glass used as reinforcement.

In addition, asphalt compositions of this invention can also be used in applications where asphalt is reinforced with a siliceous filler other than glass or in addition to glass, notably including siliceous aggregates.

In one form of the invention, the asphalt compositions of this invention can be used in the treatment of glass fibers to improve the bonding relationship between the glass fibers and a wide variety of materials reinforced with glass. For example, the asphalt compositions of the invention can be applied as a thin coating to individual glass fiber filaments, or as an impregnant to bundles of glass fibers whereby the asphalt coating or impregnant serves to intertie the glass fiber surface with, for example, treated or untreated asphalt used in road repair and/or road paving applications. In this embodiment of the invention, the coated or impregnated glass fibers can advantageously be used as reinforcement for unmodified asphalt in road paving applications whereby the asphalt matrix of the road paving material is chemically bonded to the coating or the impregnant to the glass fibers. The asphalt forming the coating or impregnant, in turn, serves to intertie the chemically-modified asphalt of this invention with the untreated asphalt, the latter forming a continuous phase in which the coated or impregnated glass fibers are distributed as reinforcement.

In another form of the invention, the chemically-modified asphalt is employed in road-paving applications, usually blended with glass fibers to provide reinforcement for the asphalt. The chemically-modified asphalt is particularly well suited for use in the repair of asphalt pavement because the asphalt of the invention, at least partially by reason of its improved compressive strength as a result of chemical modifications, has greater strength and compatibility with glass fibers as compared to untreated asphalt.

One configuration of glass fibers which has been treated with asphalt which has been found particularly suitable for use in the reinforcement of asphalt in road paving applications is a coated, or impregnated woven roving of glass fibers. The roving, after impregnation of the rubber-modified asphalt of this invention, can be embedded in an asphalt system to serve as reinforcement therefor whereby the chemically-modified asphalt present in the roving serves to increase the adhesion between the impregnated roving and the asphalt in which it is distributed as reinforcement.

In addition, the asphalt-treated glass fibers of this invention can also be used as reinforcement for other materials, including, but not limited to, rubber in the manufacture of glass fiber-reinforced elastomeric products, such as tires, and plastics, as in the manufacture of glass fiber-reinforced plastics. Glass fibers treated with the chemically-modified asphalt of this invention can be used in the repair of "potholes". In that application, glass fibers, preferably in the form of a woven roving, are embedded in a blend of asphalt and aggregate used to fill the pothole in roads to provide increased strength for the asphalt employed in filling the pothole. Glass fibers prepared in accordance with the practice of this invention can also be used in the repair of cracks whereby the glass fibers with the asphalt coating thereon markedly increase the strength of such repairs, thereby assuring improved durability.

In a preferred application, the tackiness afforded by the depolymerized rubber employed in the practice of this invention represents a significant advantage for forming adhesive compositions.

In this preferred form of the invention, the adhesive compositions of this invention are particularly well suited for use in the manufacture of road repair membranes or adhesive laminate. In that embodiment the membrane, or laminate, preferably comprises a fibrous reinforcement material which has been coated, or impregnated, with a substantially non-tacky chemically-modified asphalt, the membrane also being provided, as by coating, on one side thereof with a layer of the adhesive compositions of this invention. Thus the chemically-modified asphalt is the membrane matrix, or substantially continuous phase, in which the fibrous reinforcement material is located for strength purpose and onto one side of which is a coating of the adhesive which serves to enhance the membrane bonding to the road surface under repair. Desirably the membrane will be sufficiently flexible to allow it to be formed into rolls and in order to protect the adhesive layer and prevent membrane adherence in the rolled form prior to the time of use, the adhesive layer will be covered with a suitable removable, or releasable, skin as in the form of a tear-away strip. Reference herein to substantially non-tacky means that at room temperature the chemically-modified asphalt has significantly less tack than the adhesive.

Exemplary fibrous reinforcement materials are various mats including chopped strand mats, continuous strand mats, swirl mats, woven and non-woven fabrics, e.g., woven rovings, insect screening, scrim and the like. Preferably the fibrous materials are glass but they may also be organic polymeric materials or combinations of glass and organic polymers. Outstanding results are obtained when the non-tacky chemically-modified asphalt is the reaction product of asphalt, non-depolymerized rubber and a polymerizable vinyl aromatic monomer; the latter may be an admixture of the aforementioned monofunctional and polyfunctional vinyl monomers in the amounts previously indicated. Further details may be found in copending applications Ser. No. 045,047 and Ser. No. 144,711 both of which are hereby incorporated by reference. Suitably the non-tacky chemically-modified asphalt coating is applied to the reinforcement material by dipping the latter into a hot melt of the former. The coated membrane may then be cooled and the adhesive applied to one side. The releasable skin is then applied to the adhesive layer. The adhesive may likewise be applied as a hot melt. One suitable releasable skin is a polyethylene coated kraft paper which has a silicone overcoat which is available from Daubert Paper Co. The membrane is then preferably rolled upon itself to form a roll for on site use in road repairs.

When used in the coating or impregnation of glass fibers or bundles of glass fibers, respectively, use can be made of asphalt compositions of this invention in amounts over relatively wide ranges. Generally, the coating or impregnant is applied in an amount sufficient to consititute from 0.1 to about 50% by weight, or even higher, of the weight of the glass fibers.

It has been found, in accordance with the practice of this invention that, when employing asphalt compositions of this invention to glass fibers, either as a thin film coating on the individual glass fiber filaments or as an impregnant in bundles of glass fibers, it may be desirable to heat the asphalt after it has been applied to the glass fiber surfaces. That optional heat treatment step serves to set the asphalt coating on the glass fiber surfaces, and, at the same time, to insolubilize by further cross linking the asphalt thereon. The heating step has been found to increase the wet strength of the asphalt-treated glass fibers significantly.

In carrying out the optional heating step as described above, it is sufficient that the asphalt-treated glass fibers be heated to a temperature ranging from 200°–500° F., depending somewhat on the softening point of the asphalt involved.

Having described the basic concepts of the present invention, reference is now made to the following examples, which are provided by way of illustration and not by way of limitation, of the practice of this invention in the preparation of chemically-modified asphalts and their use.

EXAMPLE 1

This example illustrates the preparation of a chemically-modified asphalt composition employing the concepts of this invention.

A rubber-modified asphalt is prepared by mixing together the following components:

| | Parts by weight |
|---|---|
| Asphalt (AC-20) | 775 |
| Styrene | 100 |
| Depolymerized rubber (DPR-400) | 225 |

The reaction mixture is heated to about 375° F. for about 24 hours, and has good tack and adhesive characteristics.

EXAMPLE 2

The procedure of Example 1 was repeated using the following reaction mixture in which styrene was partially replaced by divinyl benzene. The latter as commercially supplied is about 55% by weight divinyl benzene with the remaining components including benzene, toluene, ethyl vinyl benzene, and diethyl benzene.

| | Parts by weight |
|---|---|
| Asphalt | 700 |
| Styrene | 50 |
| Divinyl benzene (55% by weight) | 50 |
| Depolymerized rubber (DPR-400) | 150 |

The use of divinyl benzene as a polymerizable monomer shortens the reaction time from about 24 hours to about 7–8 hours.

EXAMPLE 3

The procedure of Example 1 is again repeated with the following composition:

| | Parts by weight |
|---|---|
| Asphalt | 700 |
| Styrene | 80 |
| Terpene resin (Piccolyte A115) | 75 |
| Depolymerized rubber | 130 |

After heating for about 22 hours, a rubber-modified asphalt having a low viscosity is obtained.

EXAMPLE 4

Using the procedure as described in the foregoing examples, a reaction mixture is formulated as follows:

| | Parts by weight |
|---|---|
| Asphalt (AC-20) | 139.2 |
| Depolymerized rubber (DPR-400) | 21.6 |
| Depolymerized rubber (XL-01 from Hardman Inc.) | 2.2 |
| Styrene | 21.6 |
| SBR rubber (1205C from Phillips Petroleum Co.) | 29.5 |
| Terpene resin (A115) | 82.4 |

The reaction mixture, except for the terpene resin, is heated together at 375° F. for 20 hours, after which the terpene resin is added and then heated at the same temperature for another 2 hours.

The resulting rubber-modified asphalt is found to have good physical properties.

EXAMPLE 5

Outstanding road repair laminates are prepared as follows. The adhesive is prepared by reacting the following ingredients for about 20 hours at about 340° F.:

| | Parts by weight |
|---|---|
| Asphalt (AC-20) | 120 |
| Depolymerized Natural rubber (DPR-400) | 18.7 |
| Styrene | 18.7 |
| SBR rubber Solprene (1205C) | 25.5 |
| Terpene resin (Nevpene 9500) | 71.4 |

The chemically-modified asphalt was prepared by reacting the following at about 340° F. for about 24 hours:

| | Parts by weight |
|---|---|
| Asphalt (AC-20) | 77.5 |
| Styrene | 10.0 |
| Solprene 1205C | 12.5 |

Woven glass roving (24 ounces per square yard) is dipped into a hot melt of the above chemically-modified asphalt to coat it and then cooled. The cooled coated membrane is then coated on one side with a hot melt of the adhesive, followed by cooling and the application of Daubert Paper Company's releasable paper (1-60-EKPL-164) to the adhesive layer. This laminate is then formed into a roll for on site use as a road repair where, upon removal of the releasable paper, the adhesive shows excellent bonding characteristics. If desired the bonding can be enhanced by employing a primer. One suitable primer is a solution of a polyamide resin in a lower alkanol, e.g., 1 part by weight of Emerez 1548 (available from Emery Chemical) in 7 parts by weight of anhydrous isopropanol.

It will be understood that various changes and modifications can be made in the details of procedure, formulation and use without departing from the spirit of the invention, especially as defined in the following claims.

I claim:

1. A chemically-modified asphalt composition comprising an asphalt which has been reacted at a temperature sufficient to cause the reaction to proceed with (1) a polymerizable vinyl aromatic monomer and (2) a depolymerized rubber said depolymerized rubber being rubber which has been treated with a depolymerizing agent to decrease its molecular weight.

2. A chemically-modified asphalt composition as defined in claim 1 wherein the asphalt to be reacted is an asphalt which has been pre-reacted with a modifying agent selected from the group consisting of steam, an oxygen-containing gas, ammonia and organic amines.

3. A chemically-modified asphalt composition as defined in claim 1 wherein the vinyl aromatic monomer is styrene.

4. A chemically-modified asphalt composition as defined in claim 1 wherein the composition includes a terpene resin.

5. A chemically-modified asphalt composition as defined in claim 1 wherein the reaction takes place in the presence of a non-depolymerization rubber selected from the group consisting of homopolymers of conjugated dienes and copolymers formed of a conjugated diene and at least one ethylenic monomer copolymerizable therewith.

6. A chemically-modified asphalt composition as defined in claim 1 wherein the depolymerized rubber is selected from the group consisting of depolymerized natural rubber and depolymerized conjugated diene polymers.

7. A chemically-modified asphalt composition as defined in claim 1 wherein the vinyl aromatic monomer has the formula:

$$R_1-\underset{\underset{R_2}{|}}{C}=\underset{\underset{R_2}{|}}{C}=R_3$$

wherein $R_1$ is an aromatic group containing 6 to 12 carbon atoms, $R_2$ is hydrogen or lower alkyl and $R_3$ is selected from the group consisting of H, $-CH_2$, $-CH_2OH$, $-CHO$, $$-\overset{\overset{O}{\|}}{C}-X$$

wherein X is halogen, $$-\overset{\overset{O}{\|}}{C}-OH \text{ and } -CH_2CN.$$

8. A chemically-modified asphalt composition as defined in claim 1 wherein the reaction is carried out in the presence of a polyfunctional vinyl aromatic monomer.

9. A chemically-modified asphalt composition as defined in claim 8 wherein the polyfunctional monomer has the formula:

$$CH_2=CH-R_4-\underset{\underset{R_5}{|}}{C}=CH-R_6$$

wherein $R_4$ is a divalent aromatic group containing 6 to 12 carbon atoms, $R_5$ is H or lower alkyl and $R_6$ is selected from the group consisting of H, $-CH_2$, $-CH_2OH$, $-CHO$,

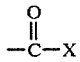

wherein X is halogen,

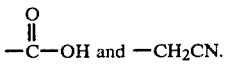

10. A chemically-modified asphalt composition as defined in claim 1 wherein the asphalt is reacted with the polymerizable vinyl aromatic monomer and the depolymerized rubber, and the resulting product is blended with the terpene resin while at an elevated temperature.

11. Glass fibers having a coating thereon, said coating comprising a chemically-modified asphalt composition as defined in claim 1.

12. Glass fibers as defined in claim 11 wherein the glass fibers are in the form of a bundle and the coating constitutes an impregnant in the bundle.

13. In a glass fiber reinforced asphalt wherein an asphalt constitutes a continuous phase in which the glass fibers are distributed as reinforcement, the improvement comprising, as the continuous phase, a chemically-modified asphalt composition as defined in claim 1.

14. In a glass fiber reinforced asphalt wherein an asphalt constitutes a continuous phase in which glass fibers, having a coating thereon, are distributed through the continuous phase as reinforcement, the improvement comprising glass fibers which have been coated with a chemically-modified asphalt composition as defined in claim 1.

15. A glass fiber asphalt composite comprising a bundle of glass fibers, said bundle of glass fibers having been impregnated with a non-tacky rubber-modified asphalt, and an adhesive coating on one surface of the impregnated bundle, said adhesive coating comprising an asphalt which has been reacted with (1) a polymerizable vinyl aromatic monomer and (2) a depolymerized rubber.

16. A composite as defined in claim 15 wherein the vinyl aromatic monomer is styrene.

17. A composite as defined in claim 15 wherein the adhesive coating includes a terpene resin.

18. A composite as defined in claim 15 wherein the depolymerized rubber has a weight average molecular weight between about 30,000 to about 80,000.

19. A composite as defined in claim 15 which includes a removable protective strip overlying said adhesive coating.

20. A flexible laminate comprising a membrane of a coated fibrous reinforcement material having an adhesive layer on one side thereof, said coating being a substantially non-tacky reaction product of asphalt, a non-depolymerized rubber and a polymerizable vinyl aromatic monomer, and said adhesive being the reaction product of a mixture comprising asphalt, a polymerizable vinyl aromatic monomer and a depolymerized rubber.

21. The laminate of claim 20 wherein said adhesive is the reaction product of a mixture which further includes a non-depolymerized rubber.

22. The laminate of claim 21 wherein said adhesive is the reaction product of a mixture which further includes a terpene resin.

23. The laminate of claim 20 or 21 wherein said adhesive further includes a terpene resin, said resin being blended with said adhesive reaction product while at a temperature between about 300° F. to 500° F.

24. The laminate of claim 20 wherein said depolymerized rubber is depolymerized natural rubber or a depolymerized synthetic conjugated diene polymer and said non-depolymerized rubber is a styrene butadiene polymer.

25. The laminate of claims 20, 21, 22 or 24 and further including a releasable skin attached to said adhesive layer.

26. The laminate of claim 20 wherein said reinforcement material is a fibrous mat.

27. The laminate of claim 26 wherein said mat is a woven glass roving.

28. A chemically-modified asphalt composition comprising asphalt which has been reacted with (1) a polymerizable vinyl aromatic monomer, (2) a depolymerized rubber, (3) a non-depolymerized rubber and (4) a terpene resin.

29. A chemically-modified asphalt composition as defined in claim 28 wherein the vinyl aromatic monomer is styrene.

30. A chemically-modified asphalt composition as defined in claim 28 wherein the depolymerized rubber is depolymerized natural rubber or a depolymerized synthetic conjugated diene rubber and said non-depolymerized rubber is a styrene butadiene copolymer.

* * * * *